US006343424B1

(12) United States Patent
Erkelenz

(10) Patent No.: US 6,343,424 B1
(45) Date of Patent: Feb. 5, 2002

(54) APPARATUS FOR DRYING AND COOLING WITH SUBSEQUENT COILING OR SHEET CUTTING OF A PAPER WEB

(75) Inventor: Willi Erkelenz, Langenfeld (DE)

(73) Assignee: Vits Maschinenbau GmbH, Langenfeld (DE)

( * ) Notice: Subject to any disclaimer, the term of this patent is extended or adjusted under 35 U.S.C. 154(b) by 0 days.

(21) Appl. No.: 09/694,769

(22) Filed: Oct. 23, 2000

(30) Foreign Application Priority Data

Oct. 21, 1999 (DE) ..... 199 50 710
Sep. 1, 2000 (DE) ..... 200 15 095

(51) Int. Cl.[7] ..... F26B 13/12

(52) U.S. Cl. ..... 34/117; 242/527; 34/120; 34/387

(58) Field of Search ..... 34/625, 62, 63, 34/387, 383, 466, 665, 236, 117, 120, 121, 391; 242/527.3, 533.4

(56) References Cited

U.S. PATENT DOCUMENTS 3,892,012 A * 7/1975 Keferstein ..... 242/56 A
4,171,780 A * 10/1979 Bugnone ..... 242/56 A
4,309,830 A * 1/1982 Vits ..... 34/120
4,529,141 A * 7/1985 McClenathan ..... 242/56 A

FOREIGN PATENT DOCUMENTS

DE 1 907 083 9/1970
DE 29 20 329 11/1980

* cited by examiner

*Primary Examiner*—Denise L. Esquivel
*Assistant Examiner*—Greg T. Warder
(74) *Attorney, Agent, or Firm*—Herbert Dubno

(57) ABSTRACT

An apparatus for drying, cooling, winding up and transverse cooling of a paper web. A lopping device is provided downstream of a conveyor segment lifting the web over the winder or sheet cutter, whichever is proximal to the cooler, the paper web then reaching a bifurcation from then which it may be directed to engagement with the mandrel in a winding readiness position of the coiler or to a conveyor segment for the transverse cutter.

20 Claims, 3 Drawing Sheets

19
18
24
23
22
32
29
28
27
34
10
14
12
8
9
11
26
25
5
54
53
49
33
35
36
37
46
44
47
21
20
4
17
45
39
42
40
38
43
31
41
30
50
51
15
3
7
13
16
6
2
52
48
1
55

60
61
1
54
5
50
63
32
68
33
65
69
35
36
16
14
12
3
8
9
11
13
15
67
46
18
19
21
17
4
20
45
47
39
76
66
74
82
75
10
72
70
64
71
49
73
62
48
6
2
51
52
59
81
A

APPARATUS FOR DRYING AND COOLING WITH SUBSEQUENT COILING OR SHEET CUTTING OF A PAPER WEB

FIELD OF THE INVENTION

The present invention relates to an apparatus for drying, cooling and, directly thereafter, coiling or cutting into sheets of a paper web. More particularly, the invention relates to an apparatus which usually comprises in a straight line, a dryer, a cooler, a coiler and a cutter so that the web can either be wound up in a coil or transversely cut into sheets which can be stacked.

BACKGROUND OF THE INVENTION

In paper web processing involving, for example, impregnation and/or coating the paper web after it has been impregnated or coated is dried in a heated condition and then is cooled. Depending upon the use it is either wound up into rolls or coiled directly or cut into sheets which are then stacked. Production lines of this type can include a dryer, cooler, coiler or roll winder and transverse cutter (sheet cutter) in a straight line.

Upon start up of the apparatus or after a tear in the web, the leading end of the paper web, which can have a width of say, 3 m and which is displaced with a speed of 50/m, is drawn through the dryer and the cooler and downstream of the cooler is engaged by service personnel and wound up or fed to a transverse cutter.

The leading end of the web, some 10 to 20 m, usually does not have the desired characteristics since the operating parameters of the dryer are usually not stabilized within this length. This portion is thus separated or lopped off and can fall as a waste upon the ground. The new leading end is placed by hand onto the coiler or the transverse cutter. For trained personnel this is usually not a difficult operation. However, because the coiler lies in the path of the web when the latter is to be fed to the transverse cutter, problems have been encountered. In such earlier systems economics are poor, substantial amounts of scrap or waste are created and the interruption in the paper feed can be substantial. DE 29 20 329 C3 describes an apparatus for drawing the paper web into a float dryer in which a transverse rod is displaced on a pair of endless traction elements like chains through the dryer and the cooler to draw the web through. The apparatus is provided with a multiplicity of rollers downstream of the dryer and the conveyor system allows the arrangement to operate with a nonstop coiler.

For guiding the chains, sprocket wheels are provided coaxial with the rollers and the mandrel. The paper web can run to a wind up star downstream of the cooler and to adhere the paper web to the winding sleeve on the mandrel, a pivot arm carrying a pressing roller and a blade shaft can be provided.

OBJECTS OF THE INVENTION

It is the principal object of the present invention to provide an apparatus for the drying, cooling and selectively, the winding up of the paper web or the transverse cutting of the paper web into sheets which can be stacked, whereby changeover between the coiling and cutting and, conversely, between sheet cutting and coiling is mechanized or automated and made more reliable.

Another object of this invention is to provide an apparatus which makes better use of operating personnel and, indeed relieves the personnel of the need for manual changeover.

Another object of the invention is to provide an apparatus of the type described which will produce significantly less waste.

SUMMARY OF THE INVENTION

These objects are attained by an apparatus for drying, cooling, coiling or sheet cutting of a paper web which comprises:

a dryer, a cooler, a coiler and a transverse cutter disposed in succession along a straight line in a path of a paper web, the coiler having at least one coiling mandrel adapted to be disposed in a winding-readiness position;

a conveyor for the paper web connected with the dryer and having one segment running from the cooler to the winding-readiness position and a further segment running from the one segment to the transverse cutter;

a lopping device proximal to the winding-readiness position for severing end portions from the paper web;

a deflector and pressing device for pressing the web onto a winding sleeve on the mandrel in the winding-readiness position, the further segment being shiftable between a position in which the web is discharged as waste and a position in which the web is fed to the transverse cutter; and laterally guided traction elements engageable with a leading end of the web and extending from an inlet to the dryer and past the cooler to a web-path bifurcation downstream of the lopping device for entraining the web to the bifurcation from the inlet to the cooler.

According to the invention, at the upstream side of the first conveyor setting running in the region of the winding mandrel, a roller pair is disposed to engage the paper web in its nip, with one of the rollers being pressed against the other.

One of the two rollers may be rubber jacketed. The lopping device can, according to the invention be located beyond the roller pair. A guide roller can be arranged in the path of the web downstream of the lopping device.

According to another feature of the invention at the end of the conveyor segment proximal to the winding mandrel in its readiness position, a roller pair can be disposed with an adjustable spacing and at least one driven roller. A spray nozzle can be located between the cooler and an associated part of the conveyor system.

The second conveyor segment which ends in the region of the transverse cutter can have a belt conveyor whose outlet side is swingable about the axis of its rerouting roller from an active position in which its upstream end is directly adjacent another conveyor segment, into a passive position in which a clearance is provided with the conveyor segments so that discarded lengths of the paper web can be discharged. The conveyor according to the invention can comprise three segments of which a first passes the paper web over the coiler or the transverse cutter. The second segment is proximal to the mandrel in readiness and feeds the paper web in a tension state in the gap between the coiler and the transverse cutter. The third conveyor segment ends at the transverse cutter.

In the region of the mandrel in its readiness portion, the second conveyor segment can run vertically.

In the third conveyor segment, a belt conveyor can be provided upstream of another belt conveyor. The upstream belt conveyor can be operated at a speed which is substantially higher then the speed with which the paper web travels. In the readiness portion of the mandrel, the neighboring segment is either horizontal or inclined slightly downwardly. This segment can be formed by conveyor tables for the paper web which in their active positions at least in part lie within the range of mobility of the coiler and thus these tables are displaceable into inactive positions outside the range of mobility.

The conveyor segments include an inlet side conveyor table which in its active position practically reaches the mandrel in its readiness portion and is located at least approximately at the same height as the mandrel. The conveyor table at the outlet side, which is proximal to the mandrel, in its active position is located at most at the same height as the inlet side conveyor table. The inlet side of the conveyor table in its active position ends above the mandrel and the outlet side conveyor table in its active portion begins below the mandrel.

The inlet side conveyor table should be displaceable in the direction of the cooler and track. The outlet side conveyor table can be raised and lowered and the conveyor tables can be formed as belt conveyors. The conveyor tables can be float tables defining a planar surface which is easily formed from sheet metal and may be slightly inclined in the web travel direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
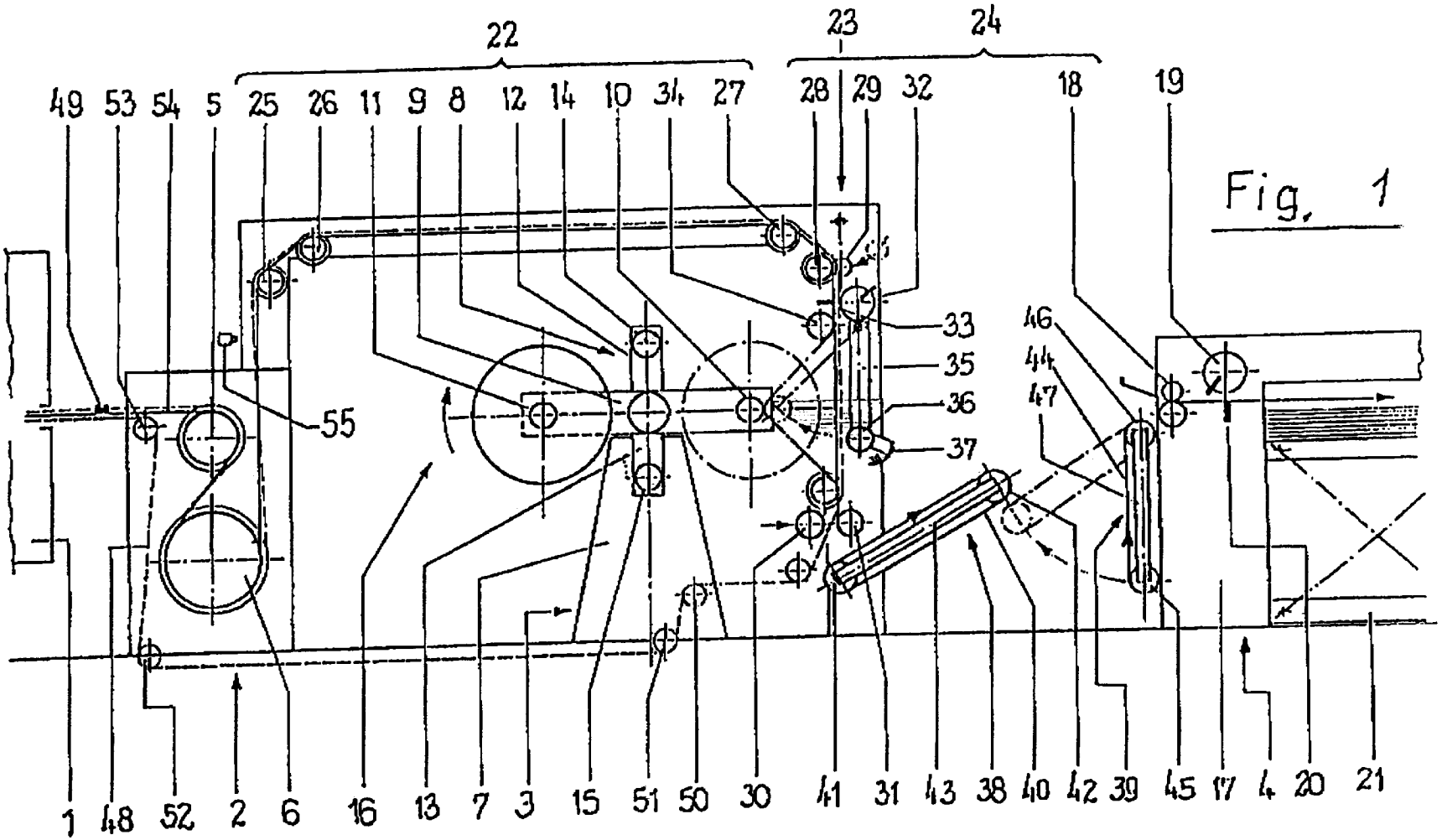
FIG. 1 is a diagrammatic elevational view of an apparatus according to the invention.

The apparatus of the invention (FIGS. 1 and 2) comprises a dryer 1 for a paper web, a cooler 2 for cooling the paper web heated in the dryer, and a coiler 3 for winding up, if desired, the cooled paper web in a roll. Alternatively to the winder 3, a transverse cutter 4 can be provided for cutting the web into sheets which can be stacked. The dryer 1, the cooler 2, the coiler 3, the transverse cutter 4 are arranged in a line one behind the other. The term "behind" in this sense is used to indicate that the stations or elements lie along the path of the paper web and are reached subsequently to a prior or more upstream station or element in question (the dryer 1 is a flotation dryer in which the paper web is suspended by an air cushion and can be of conventional design (see for example U.S. Pat. No. 4,309,870).

The cooler 2 is a drum-type cooler with two cooled rollers disposed one above the other and around which the paper web is looped.

The coiler 3 can be a nonstop coiler of conventional design. In a stand 7, there are two coiling "stars" 8, i.e. multispoked rotors, to either side of the stand 7 and rotatably journaled thereon so that they form double-armed carriers which, in the coiling position (FIG. 1) are horizontal. At the ends of the double arm carrier 9 are respective bearings for respective coiling mandrels 10 and 11. At right angles to the double arm carrier 9 are outrigger arms 12 and 13 on which guide rollers 14 and 15 are journaled. The winding stars 8 are swingable about their central axes in the direction shown by the arrow 16 through 180° so that the mandrels 10 and 11 interchange in their positions.

FIG. 1 shows the coiling mandrel 10, which is closest to the transverse cutter 4, in the operating position, i.e. the position in which this mandrel can form a coil from the paper web. The coiling mandrel 11 is in a position proximal to the dryer. In this position a fully wound coil can be removed and a new coiling tube, sleeve or core can be shoved onto the coiling mandrel.

The transverse cutter 4 is a rotary cutter with a housing 17, an intake roller pair 18 drawing the web into the cutter, a blade roller 19, a counterblade 20 and a stacking table 21.

According to the invention, a conveyor system is connected to the coiler for conveying the continuous paper web and comprises, as has been shown in FIG. 1 diagrammatically, three segments 22, 23, and 24.

Along the first conveyor segment 22 which forms a bridge over the coiler 3, a plurality of rollers 25, 26 and 27 are provided at a level such that lateral axis to the coiler 3 will not be hindered and the winding star can be pivoted without colliding with a paper web which is passed over the coiler along the segment 22.

At the roller pair 28, 29, the first conveyor segment 22 meets the second conveyor segment 23 which extends to a roller pair 30, 31. The spacing of this vertical segment 23 from the axis of the coiling mandrel 10 in the readiness position is somewhat greater than the radius of the largest coil which is to be formed in the coiler 3. In other words it is about half the axial spacing of the two coiling mandrels 10, 11 from one another. The roller 28 is rubber jacketed so that there is good adhesion of the paper to it. The rolls 28 and 29 are provided such that the roll 29 bears, as symbolized by a small arrow in the drawing, with a force against the roll 28. As has been indicated by a broken line in the drawing, the roll 29 can be lifted from the roll 28. At a short distance below the roller pair 28, 29, i.e. in the web travel direction behind the roller pair 28, 29, a lopping device is provided which in the drawing is represented by a rotatable blade 32 and a counterblade 33.

Below the lopping device but above the plane in which the axis of the winding mandrel lies, a guide roller 34 is journaled. At free ends of a pivotable arm 35, a pressing roller 36, a brush 37 and a blade which has not been designated because of the small scale used, are provided.

FIG. 1 shows the arm 35 in a position in which it is swung away from the winding mandrel 10. From this vertical rest position, it is swingable about an axis which lies a short distance below the rotating blade 32 in the direction of the winding mandrel 10 so that the pressing roller 36 as indicated by the broken line, is brought directly adjacent the mandrel 10. The roller 31 is provided with a drive (not shown). The roller 30 is adjustable in the horizontal direction one can be pressed against the roller 31.

The third conveyor stretch 24 extends substantially from the roller pair 30, 31 to the intake roller pair 18 of the transverse cutter 4. In this segment, two conveyors 38, 39 are provided as guide and transport units.

The upstream belt conveyor 38 is provided with an endless conveyor belt 40 which is guided over rerouting rollers 41 and 42. It is coupled to a drive (not shown) so that its upper pass, as symbolized by an arrow, runs with an upward inclination. The drive can be switched from the web travel speed to a substantially higher speed. The journal of the inlet side rerouting roller 41 is at a location fixed to the machine frame which has not been shown here. At the downstream side, the rerouting roller 42 is journaled on a frame 43. The second belt conveyor 39 has an endless belt 44 which is guided around rerouting rollers 45, 46 and is coupled to a drive (not shown) so that its upper pass travels in the direction represented by an arrow. The discharge side rerouting roller 48 is directly adjacent the intake roller pair 18 of the transverse cutter 4 and fixed on the machine frame. The inlet side rerouting roller 45 is journaled on a frame 47. The latter is swingable about the axis of the discharge side rerouting roller 46 and is selectively positionable either in an active or in a passive position. The active position is shown in the drawing diagrammatically in broken lines and the passive position with solid lines. In the active position, the inlet side rerouting roller 45 is inclined upwardly from a location below the outlet side rerouting roller 42 of the first belt conveyor 38. In the passive position, the frame 47 hangs vertically downwardly so that between the outlet end of the first belt conveyor 38 and the second conveyor 39, a wide gap is provided.

In the dryer 1, to both sides of the paper web, endless chains 48 are guided over sprockets which have not been shown in the drawing. On the two chains 48, a transverse bar 49 is mounted and is provided with holders or grippers for engaging the leading end of the paper web. Coaxial with the cooling rollers 5, 6 and the guide rollers 25, 26, 27, 28 and 30, on both sides, sprockets wheels are provided, as shown in broken lines and have effective diameters corresponding to the diameters of the respective rollers and are engaged by the chains. Each sprocket wheel is rotatable independently from the respective roller. The chains 48 run along the conveyor to the roller pairs 30, 31, i.e. up to the ends of the second conveyor segment. At this location, where there is a bifurcation beyond the end of the chain path, the third segment 24 is provided. The chain, however, is diverted downwardly to the left. The chain 48 returns toward the dryer 1 over sprockets 50, 51, 52, 53 and within the dryer is spaced a short distance below the web path at its entry into the dryer 1.

For start up of the apparatus, the leading end of a paper web 54, before its entry into the dryer 1, is engaged by the transverse rod 49 and drawn by the chains 48 through the dryer 1 and then around the cooling roller 5, 6. The web is then drawn upwardly over the winder 3. After the transverse rod 49 passes the deflecting roller 28, which is lifted away from the lots roller 29 for this purpose, the roller 28 returns to press the paper web against the roller 29 so that the paper web 24 is maintained taut. By operation of the rotary blade 32, the paper web 34 is lopped off. The chain 48 is stopped after the rod 49 has passed the roller 30. The piece of the paper web entrained by the rod 49 is discarded as soon as the operation allows and the rod 49 is returned to the inlet side of the dryer 1. In special cases when, for example, the paper web has become very brittle because of overdrying, the web 54 can be sprayed with water via spray heads 55 which are arranged along the path of the paper web ahead of the roller 25. This imparts a greater elasticity or flexibility to the paper web and reduces the danger of rupture of the web as it passes through the numerous direction change points of the web path.

The new leading end of the web 54 formed by lopping off the waste of the original leading end falls by its own weight to the rollers 30, 31 which initially provide a wide gap through which this portion of the web passes. Once the new leading end of the web passes between the rollers 30 and 31 the gap is then closed by pressing of the roller 30 toward the roller 31. The belt conveyor transports the paper web through the gap between the conveyor 38 and the conveyor 39 which is in a passive position so that it falls on the floor.

After a section of a length of about 10 to 20 meters has accumulated on the floor in this manner, the operating parameters of the dryer are deemed to have been stabilized and the rotary blade 32 is actuated anew. That piece of the web which is not up to the desired quality is carried way with increased speed by the conveyor 38 operated in its high speed mode. The beginning of the remainder of the paper web whose quality is stable passes through the gap between the rollers 30 and 31 onto the conveyor 38. Because of the elastic drive of the roller 31, the web is held under tension in the segment 23 of the path. The drive can be controlled by a speed regulator such that the web speed is held constant.

If it is intended that the paper should be wound up, the arm 35 swings toward the coiler 3 so that the pressing roller 36 in combination with the brush 37 presses the paper web onto a winding sleeve which previously has been provided with an adhesive strip. The winding sleeve being mounted on the winding mandrel 10. The latter is rotated with a peripheral speed equal to the speed of the oncoming web. The leading end of the paper web is separated from the roll and carried off by the belt conveyor 38.

When, however, the paper web is to be cut into sheets, after it is lopped and the transverse rod 49 with the hanging section of paper has left the conveyor stretch 23, the leading end of the advancing paper web is introduced into the gap between the rollers 30, 31 and directly thereafter into the belt conveyor 38. The paper is transported away. When the operator determines that the quality of the paper is satisfactory, the rotating blade 32 is activated which separates off the leading portion of the web so that it is carried off by the rapidly operating belt conveyor 3 and at elevated speed. When this portion of the paper has left the belt conveyor 38 but before the leading end of the paper web travelling at its normal speed has reached the discharge end of the conveyor 38, the belt conveyor 39 is swung back into its active position, eliminating the gap before the conveyors 38 and 39. The paper web then passes into the gap between the intake roller pair 18 of the transverse cutter 4.

The changeover from coiling to transverse cutting is very simple. The rotary blade 32 separate the oncoming paper web from the web delivered to the coiler and the new leading end of the paper web is supplied to the transverse cutter as has been described. The reverse interchange is also as simple. While the web is being fed to the transverse cutter 4, the arm 35 is actuated so that the web is pressed by the pressing roller 36 and the brush 37 onto the rotating winding sleeve with its adhesive strip on the winding mandrel 10. Practically simultaneously the paper web is subdivided by the cutting unit connected with the arm 35.

In the aforementioned apparatus, the dryer 1, the cooler 2 and, the coiler 3 and the transverse cutter 4 are provided in succession in a line. It is however also conceivable to interchange the positions of the coiler 3 and the transverse cutter. The transverse cutter will then be located proximal to the cooler 2 so that its intake roller pair 18, which was turned toward the coiler in the embodiment previously described, will be reversed with the coiler 3 now upstream thereof so that the intake roller pair 18 receives the web from the opposite side. In this case, in the conveyor segment 22 downstream of the cooler 2 the web is bridged over the transverse cutter 4.

Figure 2:
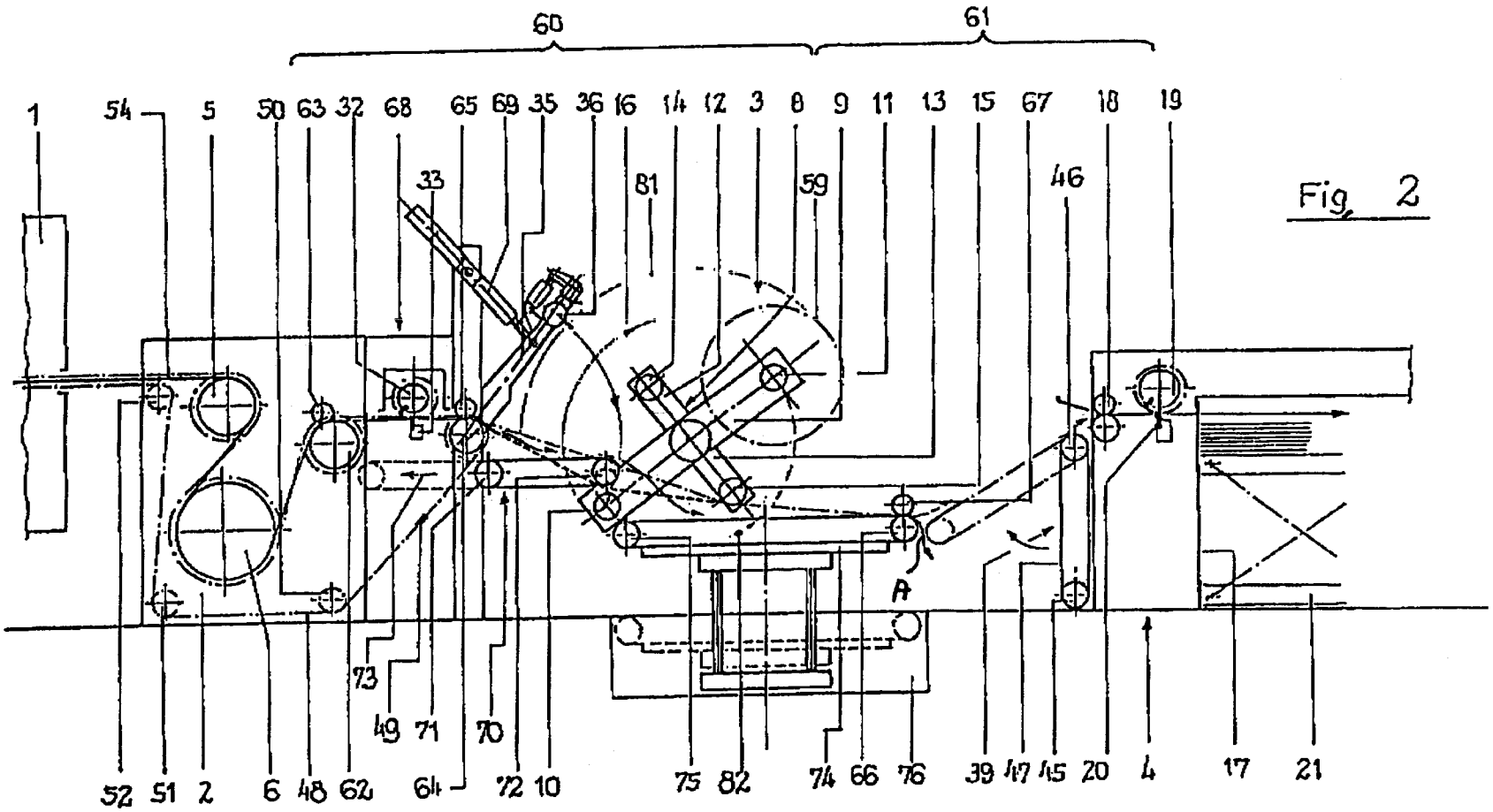
FIG. 2 is a view similar to FIG. 1 showing another embodiment.

In the embodiment of FIG. 2, components which are the same as those of FIG. 1 or function similarly have been designated with the same reference numerals and need not be referred to again. However, with respect to the coiler 3 it is to be noted that the double arm support 9 on which winding mandrels 10 and 11 are journaled, assumes a stationary position which is about 30° to 40° offset from the horizontal so that one of these mandrels will lie below the other mandrel. In a deviation from the showing of FIG. 1, the mandrel closest to the cooler 2 is seen in a roll-change position. This mandrel carries the reference numeral 10. FIG. 2 also shows diagrammatically an operating phase in which the mandrel 10 is in readiness to receive a new coil. The other mandrel 11 which is closest to the transverse cutter 4 carries a full coil 59 shown in dot-dash lines.

A conveyor device for the continuously travelling paper web 54 is connected to the cooler 2 and includes two conveyor segments 60 and 61.

The conveyor segment 60 begins behind the cooler 2 and extends from a roller pair 62, 63 over a roller pair 64, 65, located at about the same height, to a roller pair 66, 67, located somewhat lower. It thus extends at least between the roller pair 64, 65 on one side and the roller pair 66, 67 on the other side in a transport direction which extends somewhat downwardly. In the intermediate region it passes close to the coiling mandrel 10 located in the readiness position for a replacement operation.

The rollers 62, 63, 64, 65 are journaled in a machine frame 68. The roller 63 is rubber jacketed so that the continuously traveling paper web 54 will adhere without slip to this roller. It is pressed by a spring (not shown) or the like against the driven and cooled roller 62. The roller 66 is coupled with a drive (not shown) and the roller 67 can be pressed against it.

Between the roller pairs 62, 63 on the one hand and 64, 65 on the other, a lopping device is provided which has only been shown schematically in FIG. 2 and comprises a rotatable blade 32 and a stationary counterblade 33. On the frame 68 and approximately coaxial with the guide rollers 64 a pivot arm 35 is swingably mounted. At its free end this pivot arm carries a pressing roller 36 together with a brush and a blade. FIG. 2 shows at the pivot arm 35 in its rest position in which it is inclined upwardly. By means of a piston and cylinder unit 69 pivotally connected to the machine frame 68, the pivot arm can be swung in the direction of the coiling mandrel 10 and oppositely thereto back into its rest position.

Under the part of the conveyor segment 60 which extends from the roller pair 64, 65 to the proximity of the coiling mandrel 10 in its readiness position, a conveyor table 70 can be seen. Its horizontal receiving surface is formed by the upper pass of an endless conveyor belt which passes around the rollers 71, 72. The conveyor table 70 is displaceable from its active position shown in FIG. 2 in solid lines into its inactive position indicated in broken lines in the direction of the cooler 2. In the active position, the discharge side roller 92 lies perpendicular to the mandrel 10 in its readiness position and the displacement of the table is represented by the arrow 73 in FIG. 2.

Beneath the remainder of the conveyor segment 60, a further conveyor table 74 can be arranged, the horizontal receiving surface of this conveyor table being formed by the upper pass of a second conveyor belt. At the upstream side it passes around a roller 75 and at the downstream side it passes around the previously mentioned roller 66. The conveyor table 74 is displaceable from its active position shown in solid lines, in which the inlet side roller is inclined and a short distance below the coiling mandrel 10 in its readiness position, into an inactive position indicated by broken lines, downwardly in which it can disappear into a recess 76.

In the active position the two conveyor tables 70, 74 are at least partly in the working range of the coiler 3. The "working range" encompasses independently of the construction of the coiler, especially that region in which the building of the coil occurs. With the coils usually used and which can be equipped with devices for automatic coil replacement, the "working range" also includes the range through which the coiling mandrel passes and which is the region at which the build-up of the coil occurs. The inactive positions of the conveyor tables 70, 74 are so selected that the conveyor tables 70, 74 lie outside the working range. In the inactive position the build-up of the coil 1 and the coil replacement doe not interfere with one another.

In a variant, the conveyor table 70 and/or 74 can be configured as so-called flotation tables. A flotation table is here intended to refer to a conveyor device in which a paper web can travel continuously in a substantially horizontal orientation and is supported from beneath floatingly. A description of such a floating table can be found in German Patent Document DE-OS 19 07 083.

Figure 3:
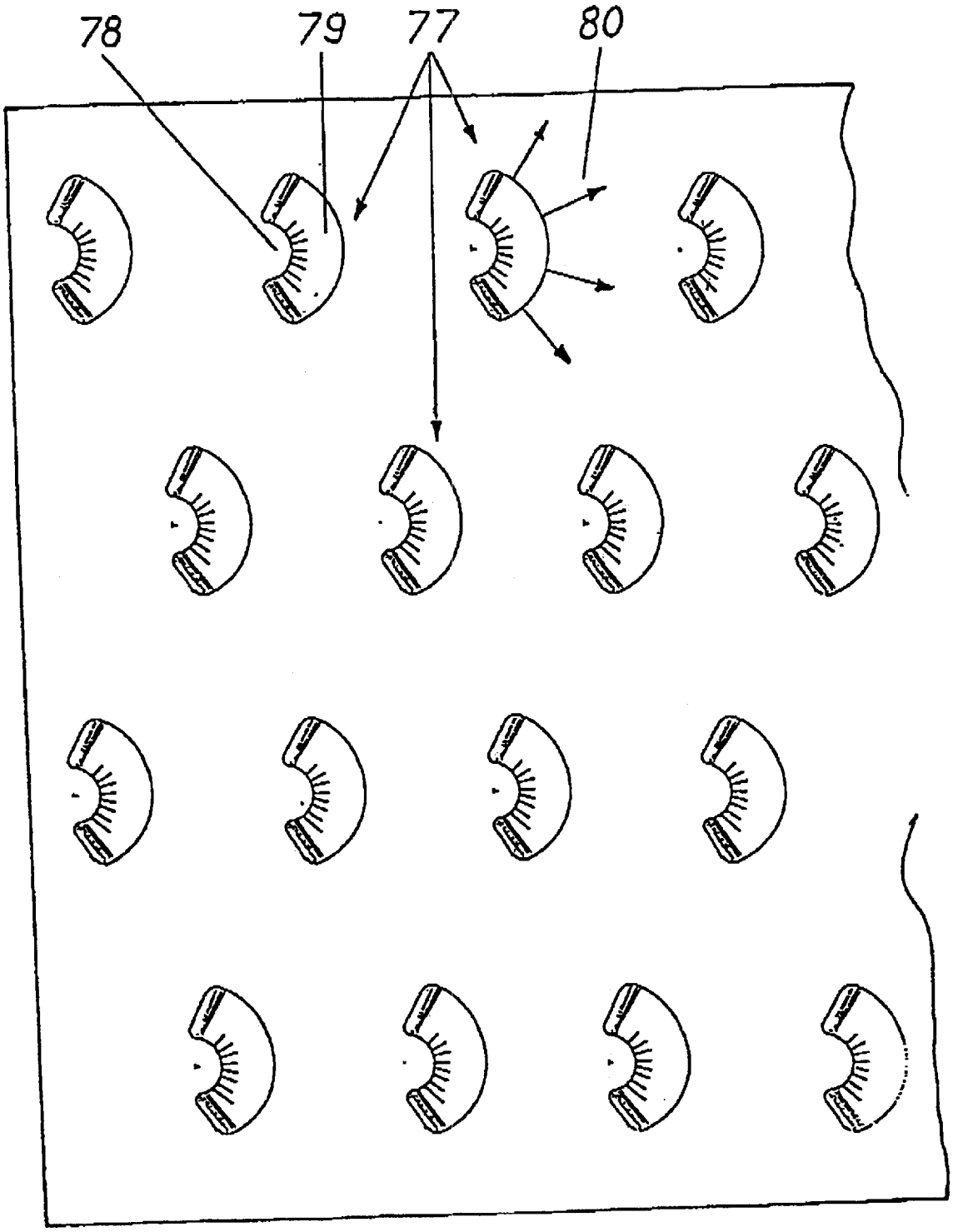
FIG. 3 is an enlarged detail view of the apparatus.

The floating table is formed by a flat air box connected to the pressure side of a blower. Its upper horizontal wall, visible in FIG. 3 is provided with numerous blowing openings distributed in a grid-like configuration. Each blowing opening is formed from an arcuate stamped out cut. The arcs extend around semicircular tongues 78. Radially outwardly of the arcs, a frustoconical depression is pressed into the planar wall. In plan view it appears as a circular ring segment extended over an angle of about 120°. Between the tongue 78 and the depressed region 79 there is provided a slit through which a divergent fan like air stream emerges as represented by the arrow 80. The air jets support the paper web floatingly at a short distance above the surface bounding the air box.

In another alternative embodiment, the conveyor tables are simple planar sheet metal surfaces which are preferably slightly inclined in the travel direction and which preferably are coated with a friction reducing synthetic resin.

In the embodiment shown in FIG. 2 as is the case also with the embodiment of FIG. 1, an apparatus is provided threading the web through the dryer and cooling unit. This apparatus can include the two laterally guided traction elements, preferably chains 48 as has been described. The ends of a transverse rod 49 are attached to the two chains 48. The chains 48 travel through the dryer 1 and the cooler 2 and travel along side the conveyor until the roller pair 54, 65 is reached. At this location there is a bifurcation in the paths. The chains 48 return via sprocket wheels 50, 51, 52 to the dryer 1.

Upon start up of the apparatus, the leading end of a paper web as is the case with the apparatus of FIG. 1, before it enters the dryer 1 is attached to the transverse rod 49 and drawn by the chains 48 through the entire dryer 1 and the cooler 2.

After the transverse rod 49 has passed the guide roller 61, the roller 65 which has been lifted to clear the rod 49, is pressed against the guide roller 64 so that the paper web is tensioned. By actuation of the rotatable blade 32, the leading portion of the paper web is lopped off. The chains 48 are stopped as soon as the rod 49 has reached an appropriate location and the piece of the paper web hanging thereon is disposed of. The rollers 62 and 63 draw the paper web along the path. The new leading end formed by the cut travels through the gap between the roller pair 64, 65 and deposits upon the conveyor table 70 upon the conveyor table 74. The two conveyor tables 70, 74 are then in their active positions. The paper travels into the gap between the conveyor table 75 and the belt conveyor 39 which is then its passive position so that it falls on the floor as represented by the arrow A.

When the operating parameters of the dryer 1 have stabilized, the rotatable blade 32 is again actuated and the portion of the paper web upstream of that blade, which has not met the quality requirements of the paper web sufficiently, is advanced by the roller pair 66, 67 at elevated speed and deposited in the gap between the 66 and 67 on the one hand and the conveyor 39 on the other.

As soon as the newly formed leading end of the paper web 1 which is sufficiently stabilized reaches the roller pair 66, 67, the web is again under tension so that is tangentially in contact with the guide roller 15 of the winder 3 from below. Because of the elastic drive of the rollers 66, 67 the web tension is maintained constant.

If it is assumed that the paper is to be coiled, the conveyor table 70 is brought into its inactive position so that the web between the roller pair, 64 on the one hand and the guide roller 15 is under tension but unsupported. The arm 35 is then driven downwardly so that it initially contact the web 54 and then presses it against an adhesive strip on the winding sleeve carried by the winding handle 10. The leading end of the paper web it cut off and is carried off by the conveyor table 74 and the roller pair 66, 67. The conveyor table 74 is lowered into the inactive position so that it is out of the way of the coil during coil winding on the mandrel 10.

When, however, the paper web is to be cut into sheets, the following is the sequence of operations: After the paper has been lopped off the rod 99 with its hanging flap of paper passes the roller 64. The leading edge of the oncoming paper web is passed into the roller pair 64, 65 and guide tables 70, 74 in their active positions through the roller paper 66, 67. From there the paper is first discharged until the quality of the oncoming web meets requirements. The rotatable blade 32 is then actuated and the separated piece of the web is discarded. When the rear end of this piece passes the roller pair 66, 67, it practically is in contact with the leading end of the conveyor table 74. The paper web is then guided into the intake roller pair 18 of the unit 4.

The switchover between coil operation and sheet cutting can be effected without interruption of the paper feed.

When the coil 59 formed on the mandrel 10 has reached its preferred full diameter, the winding star 8 is rotated until the mandrel 11 reaches the changeover position. The pivoting of the winding star swings the finished coil through the region in space surrounded by the envelope represented by the dot-dash line 81. The empty mandrel 11 describes the semicylindrical envelope represented by the dot-dash line 82. The conveyor tables 70, 74 and the pivotal arm 35 are outside the paths of the star. The partially complete coil whose outer periphery is represented by the dot-dash envelope for the coil 59 rotates a bit further. The tables 70 and 74 are brought into their active positions. The web 54 running to the practically complete coil is cut off by the rotatable blade 32. The finished coil or roll is then braked and removed from the mandrel and replaced by an empty sleeve. The new leading end of the web is fed via the conveyor tables 70, 74 again in their active positions and the belt conveyor 39 in its active position to the sheet cutter 4.

The reverse switchover is also very simple. While the web 54 runs to the sheet cutter 4 and the conveyor table 70 is in inactive position, the arm is actuated so that the web is then pressed by the pressing roller 36 against the rotating sleeve provided with its adhesive strip and provided by the winding mandrel 10. The paper web is cut by the cutter carried by the arm 35. The conveyor table 71 is then lowered so that it does not interfere with the development of the newly wound coil.

I claim:

1. An apparatus for the drying, cooling and selectively winding up into rolls and transverse cutting into stackable sheets of a paper web, said apparatus comprising:

a dryer, a cooler, a coiler and a transverse cutter disposed in succession along a straight line in a path of a paper web, said coiler having at least one coiling mandrel adapted to be disposed in a winding-readiness position;

a conveyor for said paper web connected with said dryer and having one segment running from said cooler to said winding-readiness position and a further segment running from said one segment to said transverse cutter;

a lopping device proximal to said winding-readiness position for severing end portions from said paper web;

a deflector and pressing device for pressing said web onto a winding sleeve on said mandrel in said winding-readiness position, said further segment being shiftable between a position in which said web is discharged as waste and a position in which said web is fed to said transverse cutter; and laterally guided traction elements engageable with a leading end of said web and extending from an inlet to said dryer and past said cooler to a web-path bifurcation downstream of said lopping device for entraining said web to said bifurcation from the inlet to said cooler.

2. The apparatus defined in claim 1, further comprising a roll pair located in a region of said mandrel in said winding readiness position and engageable with said web for advancing same to said mandrel and said transverse cutter, the rolls of said pair being pressed against one another.

3. The apparatus defined in claim 2 wherein at least one of said rolls of the pair is rubber jacketed.

4. The apparatus defined in claim 2 wherein said lopping device is located downstream of said roll pair and spaced a short distance therefrom in a direction of displacement of said paper web.

5. The apparatus defined in claim 4 further comprising a guide roller downstream of said lopping device and a short distance therefrom in a direction of advance of said paper web.

6. The apparatus defined in claim 1 wherein in a region of said mandrel in said winding-readiness position, a roller pair is engageable with said paper web and at least ones of the rolls of said pair is drivable, said roller pair having an adjustable spacing.

7. The apparatus defined in claim 1 further comprising a spray nozzle disposed between the cooler and said conveyor.

8. The apparatus defined in claim 1 wherein the further conveyor segment is a belt conveyor having a rerouting roller proximal to said transverse cutter and rotatable about an axis thereof, said belt conveyor being swingable from an active position in which it extends proximal to said one segment into a passive position wherein a gap is formed with said one segment through which waste material from said paper web is discharged.

9. The apparatus defined in claim 1 wherein said conveyor comprises three conveyor segments including a first conveyor segment for guiding the paper web over said coiler or said transverse cutter depending upon whether the coiler or the transverse cutter neighbors said cooler, a second conveyor segment proximal to said mandrel in said winding readiness for feeding the paper web in a tensioned space into a space between the coiler and the transverse cutter, and a third segment at the conveyor segment terminating at said transverse cutter.

10. The apparatus defined in claim 9 wherein said second conveyor segment runs vertically in a region of said mandrel disposed in said winding readiness position.

11. The apparatus defined in claim 9 wherein a belt conveyor is provided at the third conveyor segment.

12. The apparatus defined in claim 11 wherein said further belt conveyor is driven with a speed which is substantially higher than the speed with which said paper web travels.

13. The apparatus defined in claim 1 wherein said further segment running to said transverse cutter extends horizontally or slightly inclined upwardly, the further segment being formed by a conveyor table having an active position in which said conveyor table is located partly in the region of said coiling mandrel in said winding readiness position and is displaceable into an inactive position.

14. The apparatus defined in claim 13 wherein said conveyor includes an upstream conveyor table extending in an active position substantially to said mandrel in said winding readiness position and at least at about the same height as said coiling mandrel, a conveyor table located at an inlet side and which in an active position extends substantially to said mandrel in said winding readiness position and lies at least at about the same height as the mandrel, and a conveyor table at an outlet side which has an active position at which it lies approximately the same height as the mandrel, and an outlet side conveyor table which extends form a region of said mandrel in its active position and at most has the same height as the inlet side conveyor table.

15. The apparatus defined in claim 14 wherein the inlet side conveyor table has an active position above the mandrel and the outlet side conveyor table which begins below the mandrel.

16. The apparatus according to claim 14 wherein an inlet side conveyor table is retractable in the direction of the cooler.

17. The apparatus defined in claim 14 wherein the outlet side conveyor table can be lowered until it sinks below a region of engagement by the web.

18. The apparatus defined in claim 14 wherein said conveyor tables are formed as belt conveyors.

19. The apparatus according to claim 14 wherein the conveyor tables are configured as floating tables.

20. The apparatus according to claim 14 wherein said conveyor tables are formed from planar sheet metal lightly bent in traversing the apparatus.

* * * * *